US007798341B2

(12) United States Patent
Richardson et al.

(10) Patent No.: US 7,798,341 B2
(45) Date of Patent: Sep. 21, 2010

(54) HANGING SHELVING SYSTEM

(75) Inventors: Jed C. Richardson, Batavia, IL (US); Robert Kopp, Wheaton, IL (US)

(73) Assignee: Suncast Corporation, Batavia, IL (US)

( * ) Notice: Subject to any disclaimer, the term of this patent is extended or adjusted under 35 U.S.C. 154(b) by 320 days.

(21) Appl. No.: 11/852,409

(22) Filed: Sep. 10, 2007

(65) Prior Publication Data

US 2009/0065524 A1 Mar. 12, 2009

(51) Int. Cl.
*A47F 5/08* (2006.01)

(52) U.S. Cl. ..... 211/119; 211/181.1

(58) Field of Classification Search ..... 211/113, 211/119, 117, 118, 181.1, 106; 248/317, 248/339, 340, 498
See application file for complete search history.

(56) References Cited

U.S. PATENT DOCUMENTS

| | | | | |
|---|---|---|---|---|
| 2,746,609 | A * | 5/1956 | Welsh | 108/149 |
| 3,866,381 | A | 2/1975 | Eschbach et al. | |
| 3,945,462 | A * | 3/1976 | Griswold | 182/150 |
| 4,162,730 | A * | 7/1979 | Steere et al. | 211/118 |
| 4,424,908 | A | 1/1984 | Davitz | |
| 4,557,091 | A | 12/1985 | Auer | |
| D301,673 | S * | 6/1989 | Ogden | D7/402 |
| 5,036,634 | A | 8/1991 | Lessard et al. | |
| D321,804 | S * | 11/1991 | Wolff et al. | D6/566 |
| D371,208 | S | 6/1996 | DeZen | |
| 5,542,530 | A | 8/1996 | Freelander | |
| 5,588,541 | A | 12/1996 | Goetz | |
| 5,709,158 | A | 1/1998 | Wareheim | |
| 5,810,299 | A * | 9/1998 | Poulos | 248/96 |
| 6,119,588 | A * | 9/2000 | Tiemann | 99/426 |
| 6,178,896 | B1 | 1/2001 | Houk, Jr. et al. | |
| 6,199,546 | B1 * | 3/2001 | Freemon | 126/25 B |
| 6,250,022 | B1 | 6/2001 | Paz et al. | |
| 6,286,691 | B1 | 9/2001 | Oberhaus et al. | |
| 6,341,704 | B1 * | 1/2002 | Michel, Jr. | 211/181.1 |
| 6,409,031 | B1 * | 6/2002 | Wynne | 211/119 |
| 6,435,105 | B1 * | 8/2002 | Mikich et al. | 108/42 |
| 6,497,331 | B1 * | 12/2002 | Morandi | 211/153 |
| 6,595,120 | B1 * | 7/2003 | Tiemann | 99/426 |
| D526,519 | S * | 8/2006 | Nawrocki | D6/511 |
| 7,350,458 | B2 * | 4/2008 | Leibowitz | 99/340 |
| D577,256 | S * | 9/2008 | Schutte | D7/409 |
| 7,421,957 | B2 * | 9/2008 | Baez | 108/42 |
| 2002/0023888 | A1 | 2/2002 | Wynne et al. | |

(Continued)

*Primary Examiner*—Darnell M Jayne
*Assistant Examiner*—Dan Rohrhoff
(74) *Attorney, Agent, or Firm*—McHale & Slavin, P.A.

(57) ABSTRACT

The present assembly provides a suspended shelving system. The shelving system includes a shelving panel supported by a plurality of hanger members. The shelving panel includes a plurality of longitudinal members constructed of wire or plastic. A plurality of cross members are arranged substantially transverse with respect to the longitudinal members and generally parallel with respect to each other. At least a portion of the longitudinal members and the cross members are bonded together at crossing points to comprise the shelving panel. A plurality of hanger members are rotatably secured to the cross members positioned at the distal ends of the shelving member so that they may be rotated between a storage position that is generally parallel to the underside surface of the shelving member for shipment and storage, and a support position that is substantially perpendicular to the upper surface of the shelf for suspending the shelf from an overhead member.

13 Claims, 5 Drawing Sheets

U.S. PATENT DOCUMENTS

2002/0063102 A1 5/2002 Hanneken
2006/0011568 A1 1/2006 Remmers et al.
2006/0070967 A1* 4/2006 Schaubeck et al. ..... 211/187
2007/0007223 A1 1/2007 Thrush et al.

* cited by examiner

HANGING SHELVING SYSTEM

RELATED APPLICATIONS

This application is related to U.S. patent application Ser. No. 10/674,103 filed Sep. 29, 2003 entitled, Plastic Expandable Utility Shed as well as U.S. patent application Ser. No. 11/218,030 filed Aug. 31, 2005 entitled, Hanging Shelving System for Utility Shed.

FIELD OF THE INVENTION

This invention relates generally to storage systems. More specifically, the present invention relates to a suspended modular shelving system having rotatably connected overhead supports which cooperate with overhead support members as well as the shelf to substantially prevent sway of the assembled shelf.

DESCRIPTION OF THE PRIOR ART

This invention relates generally to a large enclosure constructed of plastic structural panels. More specifically, the present invention relates to a modular construction system utilizing shelves having integrated connectors to cooperate with integrated connectors in the structural panels for stability and support.

Utility sheds are a necessity for lawn and garden care, as well as general all-around home storage space. Typically, items such as garden tractors, snow blowers, tillers, ATVs, motorcycles and the like consume a great deal of the garage floor space available, forcing the homeowner to park his automobile outside.

The large items, such as mentioned above, require accessories and supplies that must also be stored, as well as other small tools. To avoid using more floor space for these supplies, a system of shelving is usually constructed as free standing units or attached to the walls of the sheds. Free standing units are unstable, particularly when carrying a top-heavy load. And, in the modular plastic sheds now available, it is difficult to attach shelves to the plastic panels without damaging the integrity of the panels.

Modular shelving systems are well known as illustrated by U.S. Pat. No. 6,178,896 to Houk, Jr., U.S. Pat. No. 5,709,158 to Wareheim, and U.S. Pat. No. 5,588,541 to Goetz. These are stand-alone modular units with multiple horizontal shelves supported by sectional legs or, in the case of the Goetz patent, a back panel.

Ceiling mounted storage systems are also known as illustrated by Steere, Jr. et al. U.S. Pat. No. 4,162,730, Davitz U.S. Pat. No. 4,424,908, Freelander U.S. Pat. No. 5,542,530, Wynne U.S. Pat. No. 6,409,031, Oberhaus et al. U.S. Pat. No. 6,286,691, Wynne et al. U.S. Publication No. 2002/0023888, Hanneken U.S. Publication No. 2002/0063102, Remmers et al U.S. Publication No. 2006/0011568, and Thrush et al. U.S. Publication No. 2007/0007223.

The ceiling mounted shelving of the prior art generally requires the devices to be shipped in a disassembled condition to save space, therefore, the consumer must assemble the shelving for use after purchase. In addition, the prior art is substantially devoid of hangers that cooperate with the shelf to reduce excessive sway when loading or unloading the shelf. This can create a dangerous condition whereby items stored on the shelf may be caused to fall by the swaying movement.

Therefore what is needed is a suspended shelving system that can be shipped in a preassembled state. The shelving should be constructed to collapse in size for better space utilization in shipping, and thereafter be easily attached to a structure without assembly or necessity of tools. When suspended the system should include hangers that cooperate with the shelving member to substantially reduce or prevent sway of the mounted shelf.

SUMMARY OF THE INVENTION

The present invention provides a suspended shelving system. The shelving system includes a shelving panel supported by a plurality of hanger members secured to overhead member(s). The shelving panel includes a plurality of longitudinal members constructed of wire or plastic. The longitudinal members are generally arranged parallel with respect to each other. A plurality of cross members are arranged substantially transverse with respect to the longitudinal members and generally parallel with respect to each other. At least a portion of the longitudinal members and the cross members are bonded together at crossing points to comprise the shelving panel. The front and/or rear edges of the shelving member are preferably turned up or down to provide a strengthening rib(s) to increase the strength and rigidity of the shelving member.

A plurality of hanger members are rotatably secured to the cross members positioned at the distal ends of the shelving member so that they may be rotated between a storage position that is generally parallel to the underside surface of the shelving member for shipment and storage, and a support position that is substantially perpendicular to the upper surface of the shelf for suspending the shelf from an overhead member. Each hanger is provided with a base portion, a center portion and an end portion. The end portion is constructed and arranged for connection to an overhead member and is preferably provided with a C-shaped hook. The C-shaped hook can be secured to an overhead member without the need for fasteners and the like. The center portion is provided with a length sufficient for spacing the shelving panel downwardly from the overhead member or surface. The base portion includes a loop pivotally secured to one of the cross members for rotation thereabout. A stop portion extends outwardly with respect to the loop so that the stop portion engages an upper surface of the shelving member adjacent to the cross member extending through the loop. The cooperation between the base portion of the hanger member(s) and the cross member(s) of the shelf, allows the loop to act as a fulcrum point while the center portion acts as a lever to force the stop into engagement with the shelving member. This construction substantially reduces sway of the shelving panel. The hanger members at one end of the shelving member prevent sway in a first direction while the hanger members at the opposite end of the shelving member prevent sway in the opposite direction. In one embodiment, the base and the center portion are constructed and arranged to place a preload engaging force between the stop and shelving member. The pre-loaded force is maintained by connecting the C-shaped end portion to the overhead member(s), further reducing sway of the shelving system.

Accordingly, it is a primary objective of the instant invention to provide a suspended shelving system with anti-sway features.

It is another objective of the instant invention to provide a suspended shelving system having preassembled hanging members.

It is still another objective of the instant invention to provide a suspended shelving system wherein the hanging members can be rotated between a shipping/storage position, generally parallel to the bottom surface of the shelving member, and a support position substantially perpendicular to the upper surface of the shelving member.

It is still yet another objective of the instant invention to provide a suspended shelving system for cooperating with structural elements in a plastic utility shed for stability and support.

It is a further objective of the instant invention to provide a suspended shelving system with flexibility in assembly to support different size and different weight articles.

It is a still further objective of the instant invention to provide a suspended shelving system having hanging members with C-shaped distal ends which cooperate directly with overhead support members for supporting the shelf without the need for fasteners.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
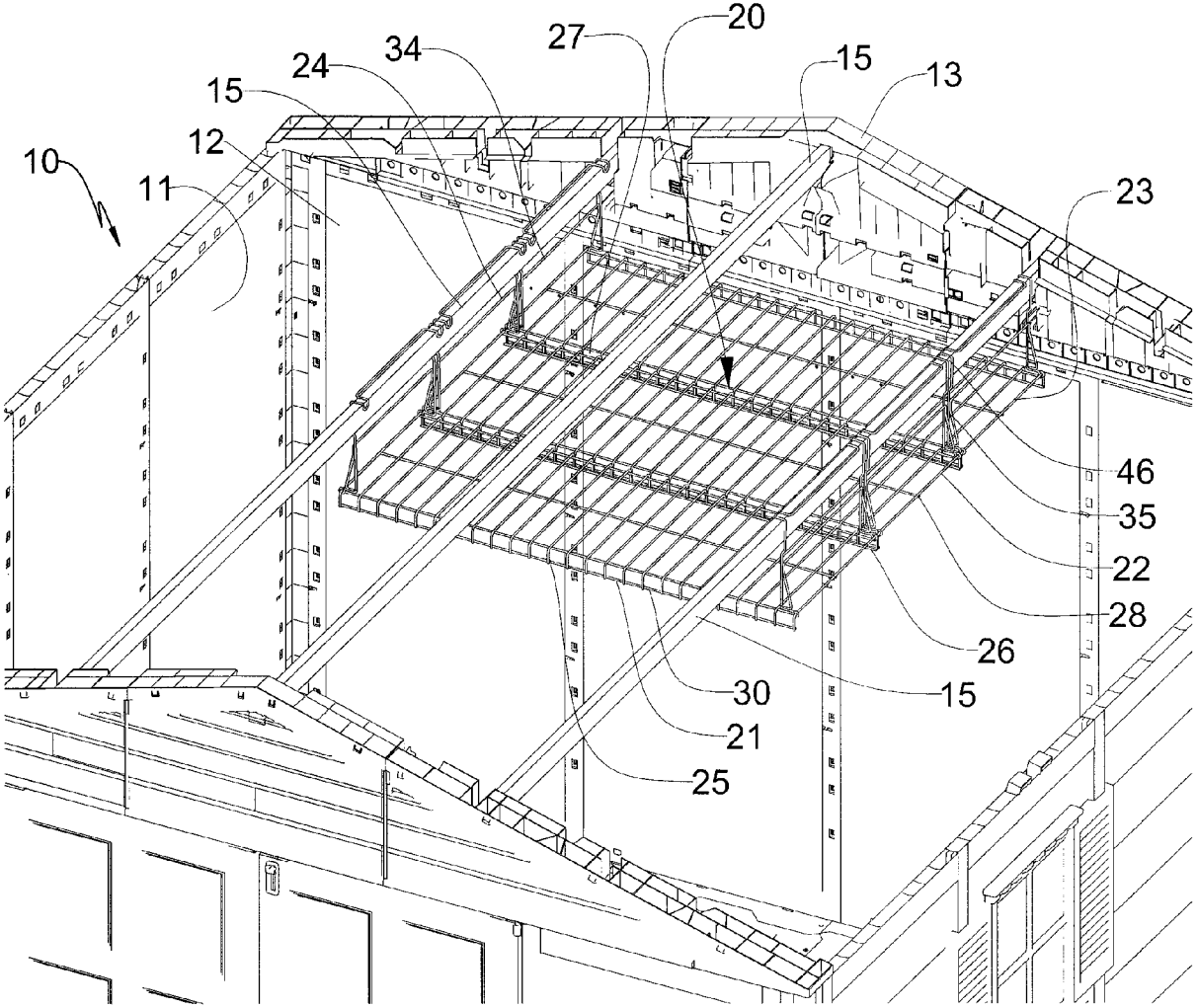
FIG. 1 is a perspective view of a utility shed illustrated with a plurality of suspended shelves in a side by side arrangement.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring to FIG. 1, the utility shed 10 is a structure assembled from molded panels with the roof panels removed. The shed may have floor panels also. The panels, including the roof panels, are reinforced with metal or wooden members for safety, structural rigidity and strength. The excess structural strength afforded by the overhead members may be utilized to support interior shelving provided as an accessory or as an after market item.

As shown, a sidewall panel 11 is joined to an end panel 12. Each of the end panels 12 have a peak 13 to support a pitched roof. The overhead member 15, in the form of a tubular steel member joins each end panel at the center of the peak. Roof overhead members 15 are disposed on opposite sides of the uppermost overhead member and at the same level with each other. The ends of the overhead members 15 abut the interior of the peak 13 allowing a continuous straight upper edge for covering the ends of the roof panels. The roof panels (not shown) are in contact with the overhead members and have spaced clips that secure the roof panels thereto. Because of the pitch of the roof, there is a vertical space between the roof panels and the overhead members on each side. By hanging shelves from the overhead members, this space can be used for storage.

Figure 2:
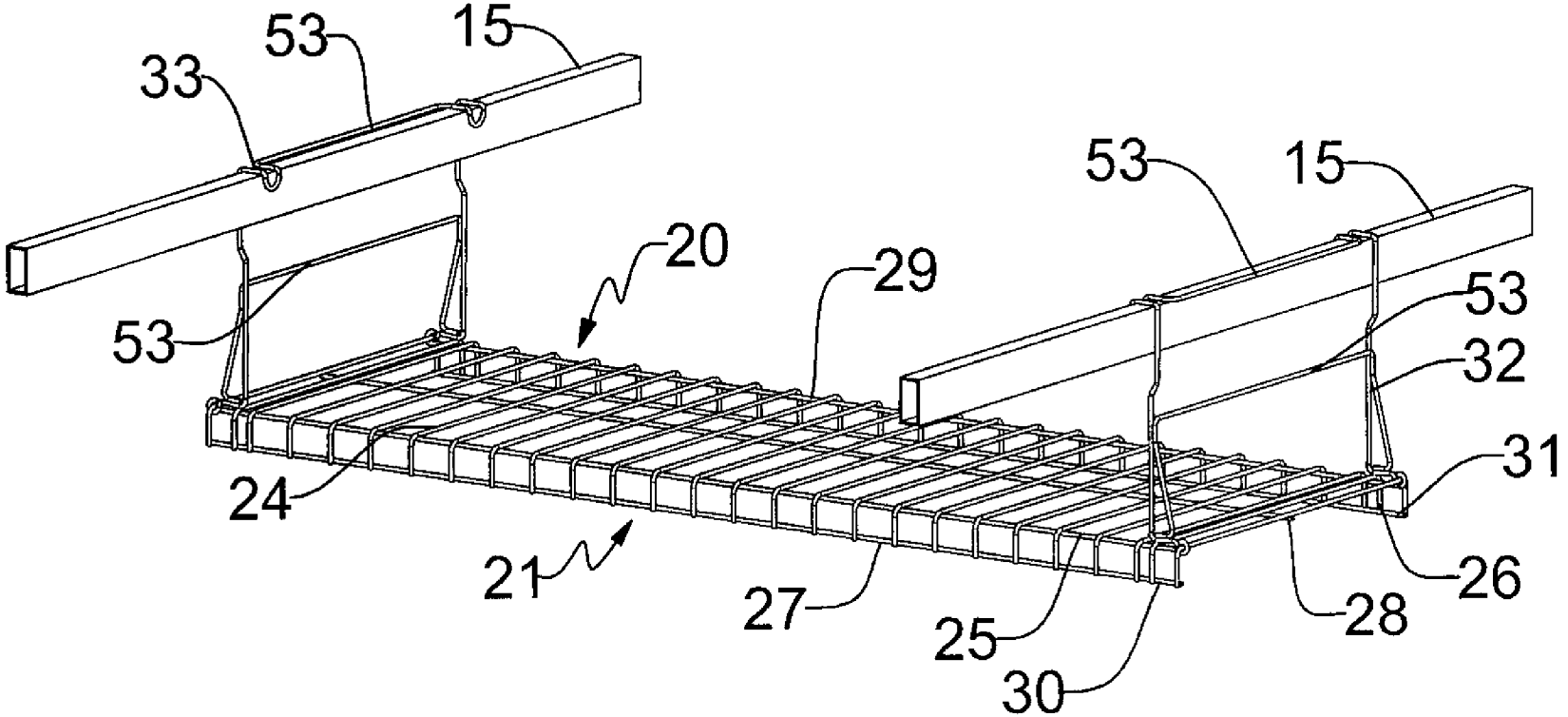
FIG. 2 is a perspective view illustrating one suspended shelf in cooperation with two overhead members.

Referring to FIGS. 1 and 2, the shelving is assembled from several long shelving members 21, 22, and 23 suspended from the overhead members by hangers 32 located at each corner of each shelf. The shelf 21 has a storage surface formed of metal or plastic cross members 24 extending across the width of the shelf. Each end of the cross members terminate with a down-turned portion 25 and 26. The cross members are supported by longitudinal members 27, 28 and 29 extending the length of the shelf. The down-turned ends are fixed to bars 30 and 31. The shelves are of a length to span the distance between the overhead members 15. Alternatively, the shelves may be constructed to have a length substantially the same as the stud spacing of a conventional home, i.e. multiples of 16 inches.

Figure 3:
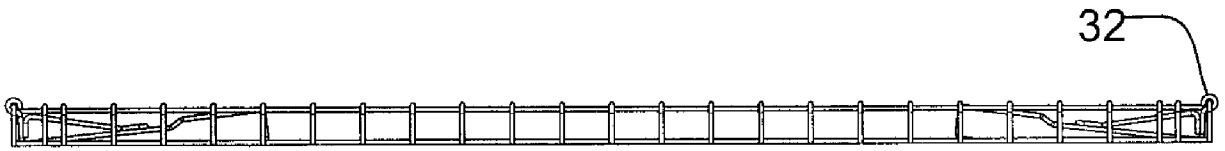
FIG. 3 is a side view illustrating a shelving assembly of the instant invention having the hanging members in a shipping/storage position.

Each hanger 32 is made of metal or plastic of requisite strength. The upper end 46 of the hanger is a C-shaped double hook with the upper portion in the shape to mate with the exterior surface of the overhead members 15. A plurality of hanger members 32 are rotatably secured to the cross members 24 positioned at the distal ends of the shelving member 21 so that they may be rotated between a storage position that is generally parallel to the underside surface of the shelving member, for shipment and storage as illustrated in FIG. 3, and a support position that is substantially perpendicular to the upper surface of the shelf for suspending the shelf from an overhead member as illustrated in FIG. 4.

Figure 4:
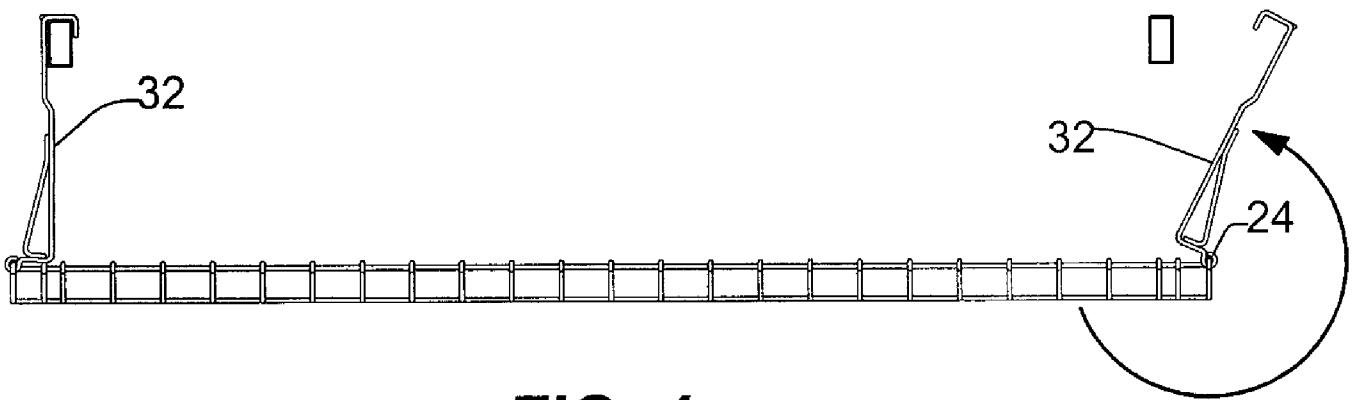
FIG. 4 is a side view illustrating pivoting the hanging members from the storage/shipping position to a support position.
Figures 5A, 5B:
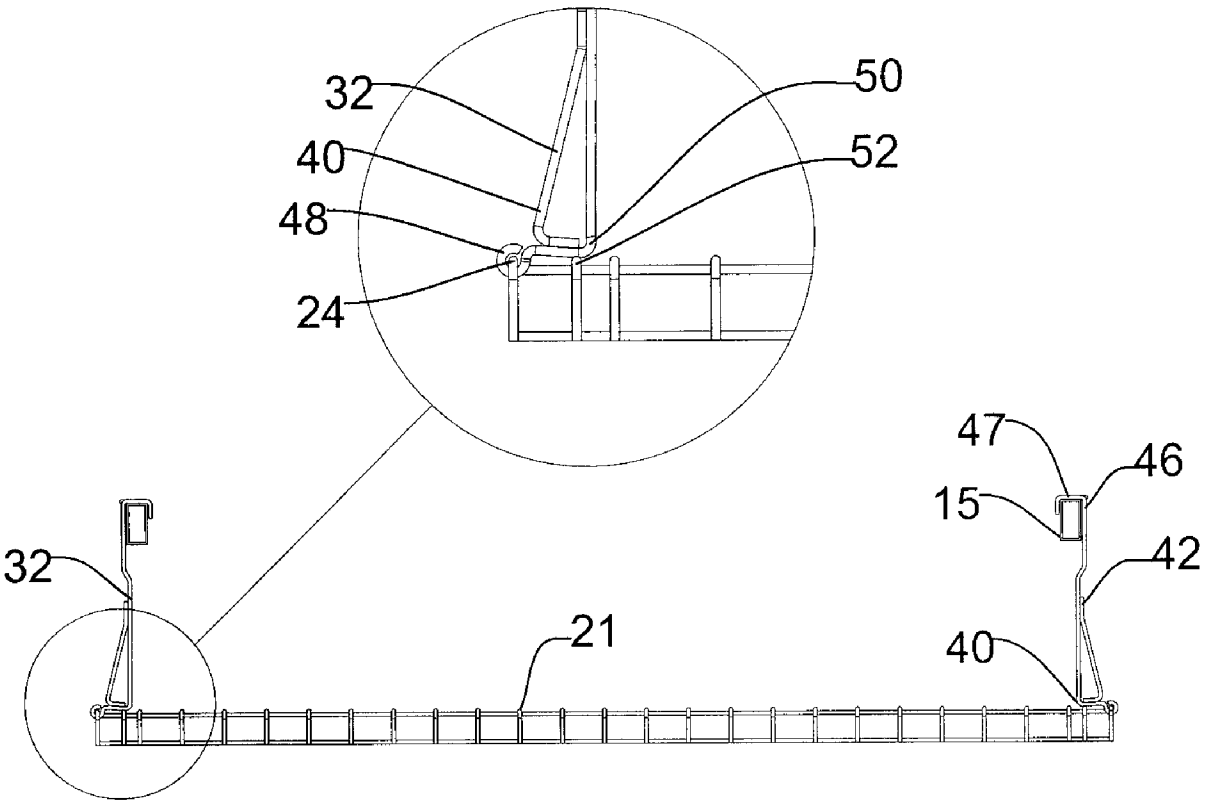
FIG. 5A is a side view of one embodiment of the instant invention illustrating the engagement of the stop portion of the hanging members to an upper surface of a shelving member.
FIG. 5B is a partial side view of the embodiment illustrated in FIG. 5A
Figure 6:
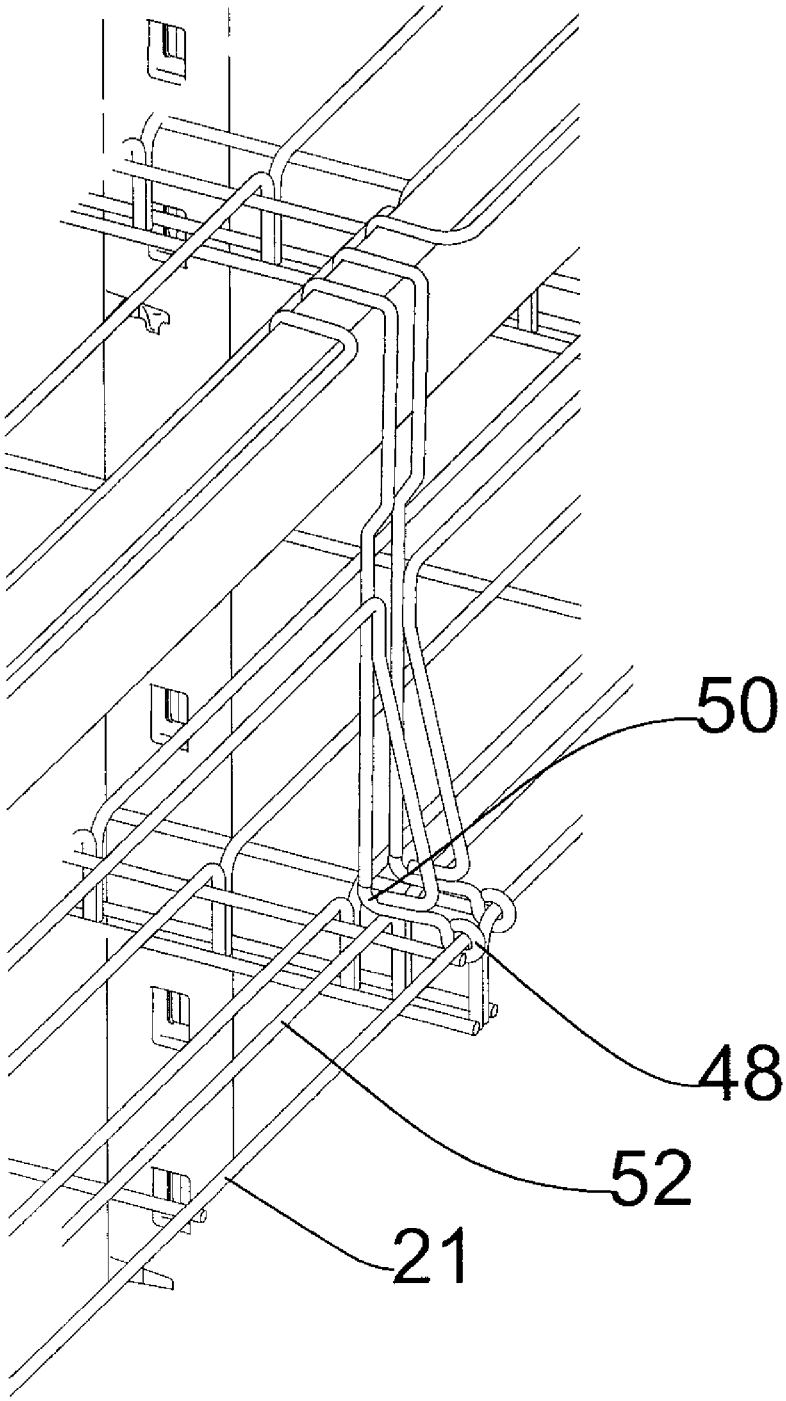
FIG. 6 is a partial perspective view illustrating the cooperation between the hanging members and the shelving member.

Referring to FIGS. 4-6, each hanger 32 is provided with a base portion 40, a center portion 42 and an end portion 46. The end portion is generally constructed and arranged for connection to an overhead member and is preferably provided with a C-shaped hook 47. The C-shaped hook can be secured to an overhead member 15, without the need for fasteners and the like. The center portion 42 is provided with a length sufficient for spacing the shelving panel downwardly from the overhead member or ceiling surface so that the shelving member can accommodate the objects to be stored and may be available in different lengths. The base portion 40 includes a loop 48 pivotally secured to one of the cross members 24 for rotation thereabout, see FIG. 4. A stop portion 50 extends outwardly with respect to the loop so that the stop portion engages an upper surface 52 of the shelving member adjacent to the cross member extending through the loop. The cooperation between the base portion of the hanger member(s) and the shelf member, allows the loop 48 to act as a fulcrum point while the center portion acts as a lever to force the stop 50 into engagement with the shelving member 21 to substantially reduce sway of the shelving panel. The hanger members at one end of the shelving member prevent sway in a first direction while the hanger members at the opposite end of the shelving member prevent sway in the opposite direction. In one embodiment, the base 40 and the center portion 42 are constructed and arranged to place a pre-loaded engaging force between the stop and shelving member. The pre-loaded force is maintained by connecting the C-shaped end portion to the overhead member(s) further reducing sway of the shelving system. In one embodiment, at least one spacer 53 is connected between hangers arranged substantially parallel to the storage surface.

The shelves may be included with the molded utility shed or a separate accessory or an after market item. The hangers are normally attached to the corners of the shelves at the factory. Assembly merely requires placing the upper C-shaped hook over the overhead members.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objects and obtain the ends and advantages mentioned, as well as those inherent therein. Any compounds, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the disclosure.

What is claimed is:

1. A suspended shelving system comprising:

a shelving panel including a plurality of longitudinal members extending generally parallel with respect to each other and a plurality of cross members arranged generally parallel with respect to each other, said cross members arranged substantially transverse with respect to said longitudinal members, at least a portion of said longitudinal members and said cross members bonded together at crossing points;

at least two hanger members for suspending said shelving panel, each hanger member including a base portion, a center portion and an end portion, said end portion constructed and arranged for connection to an overhead member, said center portion having a length sufficient for spacing said shelving panel downwardly from said overhead member, said base portion including a loop pivotally secured to one of said cross members for rotation thereabout and a stop extending outwardly with respect to said loop so that said stop engages an upper surface of said shelving panel adjacent to said cross member extending through said loop, said loop defining a fulcrum point while said center portion defines a lever to force said stop into engagement with said upper surface of said shelving panel to substantially prevent sway of said shelving panel.

2. The suspended shelving system of claim 1 wherein each of said hanger members is constructed and arranged to rotate between a storage position and a support position.

3. The suspended shelving system of claim 2 wherein each of said hanger members can be rotated about said cross member engaged by said loop between said storage position under said shelving panel to a position substantially perpendicular to a top surface of said shelving panel.

4. The suspended shelving system of claim 1 wherein said shelving panel includes a front edge and a rear edge, at least one of said front or rear edges being down-turned for providing strength and rigidity to said shelving panel.

5. The suspended shelving system of claim 4 including a storage surface defined on the shelving panel, wherein said storage surface has a first end and a second end, at least two hanger members at said first end and at least two hanger members at said second end, said at least two hanger members at said first end connected by a spacer parallel to said storage surface, said at least two hanger members at said second end connected by another spacer parallel to said storage surface.

6. The suspended shelving system of claim 1 wherein said shelving panel includes a front edge and a rear edge, both said front and said rear edges being down-turned for providing strength and rigidity to said shelving panel.

7. The suspended shelving system of claim 1 wherein said shelving panel includes a front edge and a rear edge, at least one of said front or rear edges including a bent portion defining a strengthening rib for providing strength and rigidity to said shelving panel.

8. The suspended shelving system of claim 7 wherein both of said front and said rear edges include a strengthening rib for providing strength and rigidity to said shelving panel.

9. The suspended shelving system of claim 1 including four hanger members for suspending said shelving panel, whereby two of said hanger members are secured at each distal end of said shelving member.

10. The suspended shelving system of claim 9 including a spacer connected between said center portions of said two hanger members positioned at each distal end of said shelving member.

11. The suspended shelving system of claim 9 including a spacer connected between said end portions of said two hanger members positioned at each distal end of said shelving member.

12. The suspended shelving system of claim 9 wherein said end portions of said hanger members are C-shaped.

13. A hanging shelving system for suspension below overhead members in a molded utility shed comprising a plurality of shelves, each of said plurality of shelves having a storage surface formed of a series of cross members extending the width of the shelf, said cross members supported by longitudinal bars, said storage surface defined by four corners spaced apart, a first, second, third and fourth hanger at each of said four corners, each hanger having an upper end formed as a hook to engage said overhead members, a lower end formed as a loop to surround one of said cross members, and a center portion connecting said upper and lower ends, a stop member projecting outward from said loop for engaging said storage surface, said loop defining a fulcrum point while said center portion defines a lever to force said stop member into engagement with the upper surface of said shelving panel, a first spacer with a first end and a second end disposed parallel to said cross members, said first end connected to a said first hanger intermediate said upper end and said lower end, said second end connected to said second hanger intermediate said upper end and said lower end, a second spacer with a third end and a fourth end disposed parallel to said cross members, said third end connected to said third hanger intermediate said upper end and said lower end and said fourth end connected to said fourth hanger intermediate said upper end and said lower end.

* * * * *